United States Patent [19]

Bricker et al.

[11] Patent Number: 4,923,596

[45] Date of Patent: May 8, 1990

[54] USE OF QUATERNARY AMMONIUM COMPOUNDS IN A LIQUID/LIQUID PROCESS FOR SWEETENING A SOUR HYDROCARBON FRACTION

[75] Inventors: Jeffery C. Bricker, Buffalo Grove; Robert R. Frame, Glenview, both of Ill.; Bryan L. Benedict, Redondo Beach, Calif.; Sheila L. Pollastrini, Bloomingdale, Ill.

[73] Assignee: UOP, Des Plaines, Ill.

[21] Appl. No.: 354,966

[22] Filed: May 22, 1989

[51] Int. Cl.[5] ..... C10G 27/10

[52] U.S. Cl. ..... 208/207; 208/189

[58] Field of Search ..... 208/20 A

[56] References Cited

U.S. PATENT DOCUMENTS

| | | | |
|---|---|---|---|
| 2,918,426 | 12/1959 | Quiquerez et al. | 208/206 |
| 2,966,453 | 12/1960 | Gleim et al. | 208/206 |
| 2,999,806 | 12/1961 | Thompson | 208/206 |
| 3,252,892 | 5/1966 | Gleim | 208/206 |
| 3,980,582 | 9/1976 | Anderson, Jr. et al. | 252/428 |
| 4,019,869 | 4/1977 | Morris | 23/288 R |
| 4,124,494 | 11/1978 | Frame | 208/207 |
| 4,156,641 | 5/1979 | Frame | 208/207 |
| 4,157,312 | 6/1979 | Frame | 208/207 |
| 4,201,626 | 5/1980 | Asdigian | 196/14.52 |
| 4,203,827 | 5/1980 | Frame | 208/206 |
| 4,234,544 | 11/1980 | Christman | 422/256 |
| 4,260,479 | 4/1981 | Frame | 208/207 |
| 4,276,194 | 6/1981 | Carlson | 208/207 |
| 4,290,913 | 9/1981 | Frame | 252/428 |
| 4,290,916 | 9/1981 | Carlson | 208/207 |
| 4,324,650 | 4/1982 | Carlson | 208/207 |
| 4,337,147 | 6/1982 | Frame | 208/207 |
| 4,354,926 | 10/1982 | Carlson | 208/207 |
| 4,360,421 | 11/1982 | Frame | 208/207 |
| 4,374,042 | 2/1983 | Frame | 208/207 |
| 4,498,977 | 2/1985 | Frame | 208/207 |
| 4,502,949 | 3/1985 | Frame et al. | 208/207 |
| 4,574,121 | 3/1986 | Frame | 208/207 |

*Primary Examiner*—Helane Myers

*Attorney, Agent, or Firm*—Thomas K. McBride; Eugene I. Snyder; Frank S. Molinaro

[57] ABSTRACT

This invention relates to an improved liquid/liquid process for oxidizing mercaptans in a sour hydrocarbon fraction. The improvement is the addition of a quaternary ammonium compound to the alkali metal solution which contains a metal chelate such as a metal phthalocyanine. A preferred type of quaternary ammonium compound is a surfactant quaternary ammonium compound. A synergistic effect between the quaternary ammonium compound and the metal chelate is observed.

6 Claims, No Drawings

USE OF QUATERNARY AMMONIUM COMPOUNDS IN A LIQUID/LIQUID PROCESS FOR SWEETENING A SOUR HYDROCARBON FRACTION

Processes for the treatment of a sour hydrocarbon fraction where the fraction is treated by contacting it with an oxidation catalyst and an alkaline agent in the presence of an oxidizing agent at reaction conditions have become well known and widely practiced in the petroleum refining industry. These processes are typically designed to effect the oxidation of offensive mercaptans contained in a sour hydrocarbon fraction to innocuous disulfides—a process commonly referred to as sweetening. The oxidizing agent is most often air. Gasoline, including natural, straight run and cracked gasolines, is the most frequently treated sour hydrocarbon fraction. Other sour hydrocarbon fractions which can be treated include the normally gaseous petroleum fraction as well as naphtha, kerosene, jet fuel, fuel oil, and the like.

A commonly used continuous process for treating sour hydrocarbon fractions entails contacting the fraction with a metal phthalocyanine catalyst dispersed in an aqueous caustic solution to yield a doctor sweet product. The sour fraction and the catalyst containing aqueous caustic solution provide a liquid-liquid system wherein mercaptans are converted to disulfides at the interface of the immiscible solutions in the presence of an oxidizing agent—usually air. The prior art shows that catalysts such as metal phthalocyanines can be used to oxidize the mercaptans. See, e.g., U.S. Pat. No. 2,999,806.

Applicants have found that adding a quaternary ammonium compound to the caustic or alkaline solution enhances the ability of the oxidation catalyst to convert the mercaptans to disulfides. In particular, applicants have discovered that a preferred quaternary ammonium compound is a surfactant quaternary ammonium compound. Although quaternary ammonium compounds have been used in sweetening sour hydrocarbon fractions, they have been used in conjunction with fixed bed catalysts, e.g., a metal phthalocyanine deposited on an activated charcoal. See, e.g., U.S. Pat. Nos. 4,156,641, 4,124,494, 4,260,479 and 4,203,827. There is no mention in the prior art of a quaternary ammonium compound being used in solution with an oxidation catalyst to oxidize mercaptans to disulfides.

Applicants have also discovered that there is a synergism between the quaternary ammonium compound and the oxidation catalyst, e.g., metal phthalocyanine. That is, the enhancement in oxidation rate is larger than the sum of the rate for the oxidation catalyst and the quaternary ammonium compounds.

SUMMARY OF THE INVENTION

It is a broad objective of this invention to present an improved process for treating a sour hydrocarbon fraction containing mercaptans. Thus, one broad embodiment of the invention is a process for sweetening a source hydrocarbon fraction containing mercaptans comprising contacting the hydrocarbon fraction in the presence of an oxidizing agent with an alkaline solution containing a metal chelate and a quaternary ammonium compound having the structural formula

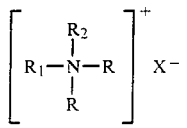

where R is a hydrocarbon group containing up to about 20 carbon atoms and selected from the group consisting of alkyl, cycloalkyl, aryl, alkaryl, and aralkyl; $R_1$ is a straight chain alkyl group containing from about 5 to about 20 carbon atoms, $R_2$ is a hydrocarbon group selected from the group consisting of aryl, alkaryl and aralkyl; and X is an anion selected from the group consisting of halide, hydroxide, nitrate, sulfate, phosphate, acetate, citrate and tartrate. Other objects and embodiments of this invention will become apparent in the following detailed description.

DETAILED DESCRIPTION OF THE INVENTION

As stated, the process of this invention comprises contacting a sour hydrocarbon fraction in the presence of an oxidizing agent with an alkaline solution containing a metal chelate and a quaternary ammonium compound. The alkaline solution is an aqueous solution containing from about 0.1 to about 25 weight percent, preferably from about 0.1 to about 10 weight percent, and most preferably from about 0.5 to about 7 weight percent of an alkali metal hydroxide. Sodium and potassium hydroxides are preferred, although lithium hydroxide, rubidium hydroxide and cesium hydroxide may also be used. The metal chelate employed in the practice of this invention can be any of the various metal chelates known to the art as effective in catalyzing the oxidation of mercaptans contained in a sour petroleum distillate, to disulfides or polysulfides. The metal chelates include the metal compounds of tetrapyridinoporphyrazine described in U.S. Pat. No. 3,980,582, e.g., cobalt tetrapyridinoporphyrazine; porphyrin and metaloporphyrin catalysts as described in U.S. Pat. No. 2,966,453, e.g., cobalt tetraphenylporphyrin sulfonate; corrinoid catalysts as described in U.S. Pat. No. 3,252,892, e.g., cobalt corrin sulfonate; chelate organometallic catalysts such as described in U.S. Pat. No. 2,918,426, e.g., the condensation product of an aminophenol and a metal of Group VIII; the metal phthalocyanines as described in U.S. Pat. No. 4,290,913, etc. As stated in U.S. Pat. No. 4,290,913, metal phthalocyanines are a preferred class of metal chelates. All the above-named patents are incorporated herein by reference.

The metal phthalocyanines which can be employed to catalyze the oxidation of mercaptans generally include magnesium phthalocyanine, titanium phthalocyanine, hafnium phthalocyanine, vanadium phthalocyanine, tantalum phthalocyanine, molybdenum phthalocyanine, manganese phthalocyanine, iron phthalocyanine, cobalt phthalocyanine, platinum phthalocyanine, palladium phthalocyanine, copper phthalocyanine, silver phthalocyanine, zinc phthalocyanine, tin phthalocyanine, and the like. Cobalt phthalocyanine and vanadium phthalocyanine are particularly preferred. The ring substituted metal phthalocyanines are generally employed in preference to the unsubstituted metal phthalocyanine (see U.S. Pat. No. 4,290,913), with the sulfonated metal phthalocyanine being especially preferred, e.g., cobalt phthalocyanine monosulfate, cobalt phthalocyanine disulfonate, etc. The sulfonated derivatives may be prepared, for example, by reacting cobalt, vanadium or other metal phthalocyanine with fuming sulfuric acid. While the sulfonated derivatives are preferred, it is understood that other derivatives, particularly the carboxylated derivatives, may be employed. The carboxylated derivatives are readily prepared by the action of trichloroacetic acid on the metal phthalocyanine. The concentration of metal chelate and metal phthalocyanine can vary from about 0.1 to about 2000 ppm and preferably from about 50 to about 800 ppm.

The quaternary ammonium compound which may be used has the formula

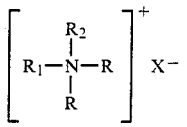

where R is a hydrocarbon group containing up to about 20 carbon atoms and selected from the group consisting of alkyl, cycloalkyl, aryl, alkaryl, and aralkyl; $R_1$ is a straight chain alkyl group containing from about 5 to about 20 carbon atoms; $R_2$ is a hydrocarbon group selected from the group consisting of aryl, alkaryl and aralkyl; and X is an anion selected from the group consisting of halide, hydroxide, nitrate, sulfate, phosphate, acetate, citrate and tartrate. Illustrative examples of the quaternary ammonium compounds which can be used to practice this invention, but which are not intended to limit the scope of this invention are: benzyldimethyldodecylammonium hydroxide, benzyldimethyltetradecylammonium hydroxide, benzyldimethylhexadecylammonium hydroxide, benzyldimethyloctadecylammonium hydroxide, dimethylcyclohexyloctylammonium hydroxide, diethylcyclohexyloctylammonium hydroxide, dipropylcyclohexyloctylammonium hydroxide, dimethylcyclohexyldecylammonium hydroxide, diethylcyclohexyldecylammonium hydroxide, dipropylcyclohexyldecylammonium hydroxide, dimethylcyclohexyldodecylammonium hydroxide, diethylcyclohexyldodecylammonium hydroxide, dipropylcyclohexyldodecylammonium hydroxide, dimethylcyclohexyltetradecylammonium hydroxide, diethylcyclohexyltetradecylammonium hydroxide, dipropylcyclohexyltetradecylammonium hydroxide, dimethylcyclohexylhexadecylammonium hydroxide, diethylcyclohexylhexadecylammonium hydroxide, dipropylcyclohexylhexadecylammonium hydroxide, dimethylcyclohexyloctadecylammonium hydroxide, diethylcyclohexyloctadecylammonium hydroxide, dipropylcyclohexyloctadecylammonium hydroxide, as well as the corresponding fluoride, chloride, bromide, iodide, sulfate, nitrate, nitrite, phosphate, acetate, citrate and tartrate compounds. The hydroxide compounds are preferred and especially preferred hydroxides are benzyldimethyldodecylammonium hydroxide, benzyldimethyltetradecylammonium hydroxide, benzyldimethylhexadecylammonium hydroxide and benzyldimethyloctadecylammonium hydroxide. The concentration of quaternary ammonium compound in the alkaline solution can vary from about 1 to about 5000, preferably from about 2 to about 100 ppm, and most preferably from about 5 to about 20 ppm.

As stated, preferred quaternary ammonium compounds are surfactant quaternary ammonium compound. By surfactant is meant a compound that has a critical micelle concentration (CMC) of less than 0.2 molar. Examples of ammonium quaternary compounds and their CMC are presented in Table A.

TABLE A

| COMPOUND | CMC (MOLAR) |
|---|---|
| Hexadecyltrimethylammonium bromide | 0.0009 |
| Dodecyltrimethylammonium bromide | 0.0156 |
| Octyltrimethylammonium bromide | 0.13 |
| Hexyltrimethylammonium bromide | 0.22 |

Sweetening of the sour hydrocarbon fraction is effected by oxidation of mercaptans. Accordingly, an oxidizing agent is necessary for the reaction to proceed. Air is a preferred oxidizing agent, although oxygen or other oxygen-containing gases may be used. At least a stoichiometric amount of oxygen (relative to the concentration of mercaptans) is required to oxidize the mercaptans to disulfides, although an excess amount of oxygen is usually employed. In some cases the sour hydrocarbon fraction may contain entrained air or oxygen in sufficient concentration to accomplish the desired sweetening, but generally it is preferred to introduce air into the reaction zone.

Sweetening of the sour hydrocarbon fraction may be effected in any suitable manner well known in the art and may be in a batch or continuous process. In a batch process the sour hydrocarbon fraction is introduced into a reaction zone containing the alkaline solution which contains the metal chelate and the quaternary ammonium compound. Air is introduced therein or passed therethrough. Preferably the reaction zone is equipped with suitable stirrers or other mixing devices to obtain intimate mixing. In a continuous process the alkaline solution containing the metal chelate catalyst and the quaternary ammonium compounds is passed countercurrently or concurrently with the sour hydrocarbon fraction in the presence of a continuous stream of air. In a mixed type process, the reaction zone contains the alkaline solution, metal chelate and quaternary ammonium compound, and gasoline and air are continuously passed therethrough and removed generally from the upper portion of the reaction zne. For specific examples of apparatus used to carry out a liquid/liquid process, see U.S. Pat. Nos. 4,019,869, 4,201,626 and 4,234,544 which are incorporated by reference.

In general the process is usually effected at ambient temperatures, although elevated temperatures may be employed and generally will be in the range of from about 100° to about 400° F., depending upon the pressure utilized therein, but usually below that at which substantial vaporization occurs. Pressures of up to about 1,000 psi or more are operable although atmospheric or substantially atmospheric pressures are suitable.

The following examples are presented in illustration of this invention and are not intended as undue limitations on the generally broad scope of the invention as set out in the appended claims.

EXAMPLE I

A stirred contactor which consisted of a cylindrical glass container measuring 3.5 inches in diameter by 6 inches high and which contained 4 baffles that are at 90° angles to the side walls was used. An air driven motor was used to power a paddle stirrer positioned in the center of the apparatus. When turning, the stirrer paddles passed within ½" of the baffles. This resulted in a very efficient, pure type of mixing.

To the above apparatus there were added 50 milliliters of a 7% aqueous sodium hydroxide solution which contained 30 weight ppm of a caustic soluble tetrasulfonated cobalt phthalocyanine and 200 milliliters of isooctane which contained 1,300 weight ppm of mercaptan sulfur as n-octylmercaptan. To this mixture an amount of a quaternary ammonium compound was added and the mixture was stirred. Periodically stirring was stopped and a sample was withdrawn from the isooctane layer with a pipette. These samples were analyzed for mercaptan by titration.

The above experiment was repeated several times with varying amounts of a quaternary ammonium compound and with various quaternary ammonium compounds. These results are presented in Table 1.

TABLE 1

Effect of Quaternary Ammonium Compound on Mercaptan Oxidation

| Quaternary Compound | Concentration wt ppm | CoPc[1] wt ppm | Percent Mercaptan Conversion After 90 Minutes of Contact |
|---|---|---|---|
| None | — | 30 | 38 |
| Maquat TM TC-76* | 10 | 30 | 80 |
| Maquat TM TC-76* | 20 | 30 | 77 |
| Maquat TM TC-76* | 20 | 0 | 18 |
| Sumquat TM 2311** | 20 | 30 | 42 |
| Sumquat TM 2311** | 60 | 30 | 45 |

*Maquat TM TC-76 is a mixture of mono- and dimethyl, dialkyl and alkylbenzylammonium chlorides. The alkyl groups are primarily $C_{14}$ groups although other chain length groups are also present. Before use the Maquat TM TC-76 was converted to the hydroxide form by ion exchange. Maquat TM TC-76 is a tradename of the Mason Chemical Company of Chicago, IL

**Sumquat TM 2311 is trimethylbenzyl ammonium hydroxide which is a non-surfactant quaternary ammonium hydroxide. Sumquat TM is a trade name of the Hexcel Corporation of Zeeland, Michigan.

[1]CoPC is a tetrasulfonated cobalt phthalocyanine.

The data presented in Table 1 clearly show that addition of a quaternary ammonium hydroxide enhances the ability of the cobalt phthalocyanine catalyst to oxidize mercaptans to disulfides. It is also observed that a surfactant quaternary ammonium hydroxide enhances the oxidation of mercaptans to a much greater extent than a non-surfactant quaternary ammonium compound.

We claim as our invention:

1. A process for sweetening a sour hydrocarbon fraction containing mercaptans comprising contacting the hydrocarbon fraction in the presence of an oxidizing agent with an alkaline solution containing a metal chelate and a surfactant quaternary ammonium compound having the structural formula

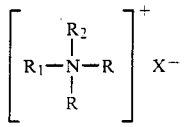

where R is a hydrocarbon group containing up to about 20 carbon atoms and selected from the group consisting of alkyl, cycloalkyl, aryl, alkaryl, and aralkyl, $R_1$ is a straight chain alkyl group containing from about 5 to about 20 carbon atoms, $R_2$ is a hydrocarbon group selected from the group consisting of aryl, alkaryl and aralkyl and X is an anion selected from the group consisting of halide, hydroxide, nitrate, sulfate, phosphate, acetate, citrate and tartrate, the surfactant quaternary ammonium compound present in a concentration from about 2 to about 100 ppm.

2. The process of claim 1 where the alkaline solution is a sodium hydroxide solution containing from about 0.1 to about 25 weight percent sodium hydroxide.

3. The process of claim 1 where the oxidizing agent is oxygen or air.

4. The process of claim 1 where the metal chelate is a metal phthalocyanine.

5. The process of claim 4 where the metal phthalocyanine is a cobalt phthalocyanine and is present in a concentration from about 0.1 to about 2000 ppm.

6. The process of claim 1 where X is hydroxide.

* * * * *